United States Patent [19]

Saxe

[11] 3,935,964

[45] Feb. 3, 1976

[54] TRASH CAN PROTECTOR

[76] Inventor: Van Rensselaer P. Saxe, 116 W. University Parkway, Baltimore, Md. 21210

[22] Filed: Apr. 30, 1974

[21] Appl. No.: 465,680

[52] U.S. Cl. ..... 220/318; 220/1 T; 220/18; 220/348; 211/83; 220/324

[51] Int. Cl.[2] ..... B65D 45/00

[58] Field of Search ..... 220/1 T, 309, 318, 348, 220/379, 324, 18; 211/83, 84; 248/147

[56] References Cited

UNITED STATES PATENTS

| | | | |
|---|---|---|---|
| 2,513,630 | 7/1950 | Elliott | 248/147 |
| 2,636,639 | 4/1953 | Frey | 220/318 |
| 2,808,173 | 10/1957 | Patnode | 220/18 |
| 3,028,015 | 4/1962 | Williams | 248/147 |
| 3,065,858 | 11/1962 | Furr | 211/84 |
| 3,291,515 | 12/1966 | Lierman | 220/318 |
| 3,378,323 | 4/1968 | Goldberg | 211/83 |
| 3,416,671 | 12/1968 | Morgan | 220/18 |
| 3,463,429 | 8/1969 | Novak | 211/83 |
| 3,547,273 | 12/1970 | Bompart | 211/84 |
| 3,817,563 | 6/1974 | McGlothin | 220/1 T |

*Primary Examiner*—William I. Price
*Assistant Examiner*—Ro E. Hart
*Attorney, Agent, or Firm*—Emory L. Groff, Jr.

[57] ABSTRACT

A protector device for cans provided with a handle includes a pivoted cover member attached to a stationary support and movable to a substantially horizontal plane overlying the can. The cover member includes anchor means precluding horizontal displacement of the can as well as anchor means engageable with the can handle to prevent unwarranted vertical displacement between the cover member and can.

7 Claims, 4 Drawing Figures

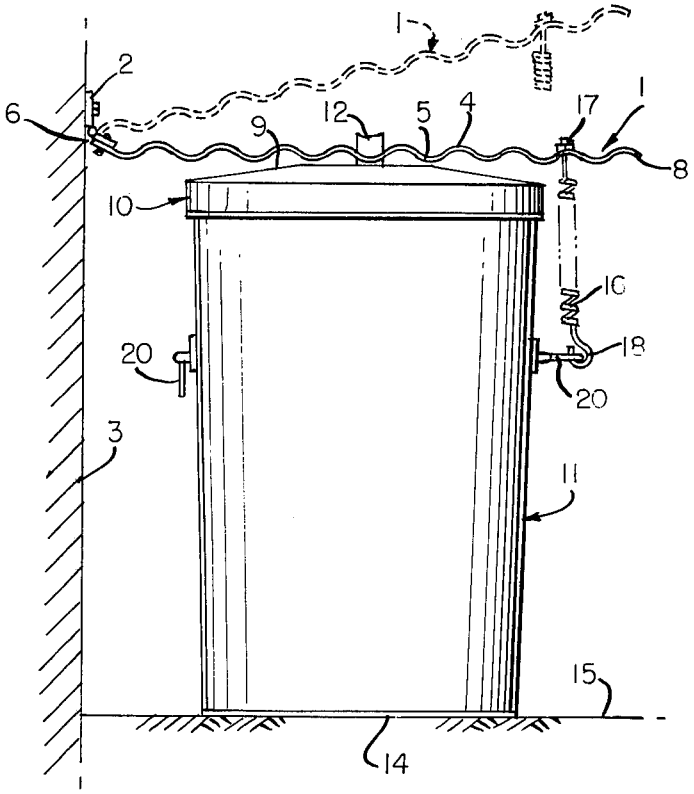
FIG. 1.
FIG. 2.
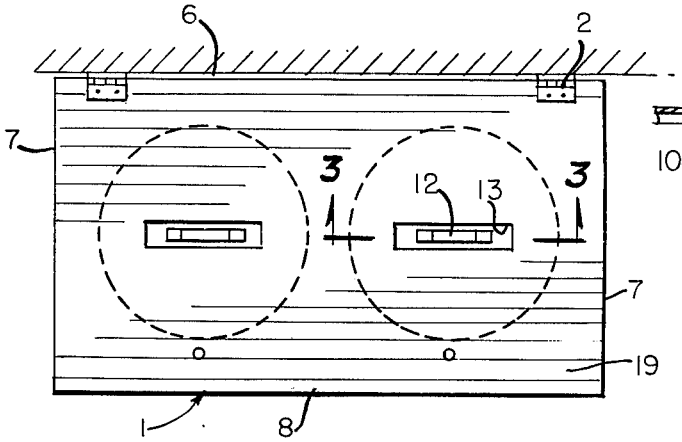
FIG. 3.
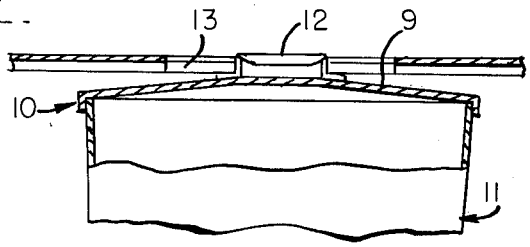
FIG. 4.
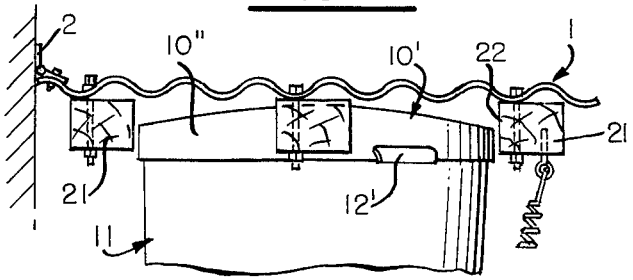

TRASH CAN PROTECTOR

This invention relates generally to protector means for receptacles and more particularly to an improved movable cover member adapted to cooperate with both a receptacle and its lid to securely retain the same.

Users of storage receptacles such as trash cans and the like will readily sympathize with the annoyance of having the contents thereof strewn along the ground due to removal of the lid or overturning of the can by either the elements or foraging animals. Many attempts have been made in the past to provide means specifically intended to assist in preventing this problem. U.S. Pat. Nos. 2,808,173 issued Oct. 1, 1957, and U.S. Pat. No. 3,416,671, issued Dec. 17, 1968, are but two examples of earlier attempted solutions and disclose pivoted means mounted upon an upright support and adapted to either engage the lid of a container or overlie the top opening of a container for the purpose of either inhibiting the upset of the container or the accidental loss of the contents of the container. These earlier devices have been found to fall far short in providing the required security for a trash can when, for example, a large animal attempts to gain access thereto since, experience has shown that mere overlying means for a trash can lid is little obstacle for a large dog or bear which is capable of horizontally displacing the trash can proper to forcefully separate the can from its lid.

The present invention, on the other hand, provides an improved movable cover member adapted to overlie a can lid and includes means thereon cooperating with this lid to preclude horizontal displacement of a can and its lid and further includes anchor means carried by the cover member and engageable with handle means provided on the can itself to preclude vertical separation between the can and its lid such that a unitary assembly results with the cover member, can lid and can body becoming a single interlocked assembly.

Accordingly, one of the primary objects of the present invention is to provide an improved trash can protector including a movable cover member adapted to overlie a trash can lid and provided with anchor means engageable with a handle on the trash can body.

A further object of the present invention is to provide an improved trash can protector including a moveable cover member completely overlying a trash can having a lid and including anchor means formed in the cover member and engageable with the can lid to preclude horizontal displacement therebetween.

Still another object of the present invention is to provide an improved trash can protector including a movable cover member adapted to overlie a trash can having a lid and including means intermediate the edges of the cover member and engageable with a handle on the lid together with a flexible means carried by the cover member engageable with a handle on the can body.

With these and other objects in view which will more readily appear as the nature of the invention is better understood, the invention consists in the novel construction, combination and arrangement of parts hereinafter more fully described, illustrated and claimed.

A preferred and practical embodiment of the invention is shown in the accompanying drawing, in which:

FIG. 1 is a side elevation of the trash can protector of the present invention and illustrates the movable cover member in alternate positions.

FIG. 2 is a top plan view of the structure shown in FIG. 1.

FIG. 3 is a fragmentary vertical sectional view taken along the line 3—3 of FIG. 2.

FIG. 4 is a fragmentary side elevation of a further embodiment of the present invention.

Similar reference characters designate corresponding parts throughout the several figures of the drawing.

Referring now to the drawing, particularly FIG. 1, the present invention will be understood to comprise a substantially planar movable hold-down or cover member, generally designated 1, which is suitably secured such as by the hinge 2, to a relatively stationary component such as the upright support 3 which may be the wall of a building. The cover member 1 may be constructed of any suitable material such as metal or plastic sheeting, and is shown in the drawing as formed of corrugated material having alternate peaks 4 and valleys 5 extending longitudinally of the cover member. This construction offers obvious advantages, including ready availability, high strength-to-weight ratio and ease of utilization in constructing the present invention, yet it will be understood that any suitable alternate form of material may be considered which offers a substantially planar element and which may preferably be formed with an inner edge 6 to which the hinge 2 is attached and which is bounded by a pair of side edges 7 which in turn join with an outer edge 8, preferably parallel to the inner edge 6.

The hinge 2 is attached to the upright support 3 so that the inner edge 6 of the cover member 1 will be disposed substantially adjacent the horizontal plane of the top 9 of a lid 10 when properly placed in the closed position upon a receptacle or can body 11. Many lids of trash cans are provided with a handle 12 projecting upwardly from the top 9 thereof in the center of the lid and this feature of construction is taken advantage of in providing horizontal anchor means in the present invention. As will be shown most clearly in FIGS. 2 and 3 of the drawing, the intermediate body portions of the cover member 1 is provided with an opening or cut-out 13 configured with a length and width slightly greater than the underlying corresponding dimensions of the handle 12 of the lid 10. With the opening 13 extending longitudinally of the cover member and intermediate the inner edge 6 and outer edge 8 thereof, it will be observed that with the bottom 14 of the can 11 disposed upon the ground or base 15, the entire can 11 will be located significantly away from the upright support 3 since the length of the side edges 7 of the cover member is selected to ensure a dimension significantly greater than the diameter of the can and lid intended to be used therewith. In this manner, when properly positioned, adequate ventilation is provided between the can body and the upright support 3 and there is little likelihood of marring the finish of the support 3 during handling of the can body prior to its anchoring with respect to the instant trash can protector.

Carried by the body of the cover member 1, intermediate the opening 13 and the outer edge 8 thereof is a clamp element, generally designated 16, which may comprise any suitable flexible element such as a length of rubber or a metal spring. The upper end of the clamp element 16 is suitably attached to the cover member 1 by means of a fastener 17 while a catch 18, preferably of the hook type, is provided at the lower portion of the clamp element 16 as shown most clearly in FIG. 1 of the drawing. As previously described, the outer edge 8 of the cover member extends laterally beyond the edge of the can lid 10 and thus the cover member may be considered to include an overhanging outer portion 19 encompassing that portion of the cover member between the edge of the lid 10 and the outer edge 8.

The clamp element 16 is preferably attached so as to be suspended from the overhanging outer portion 19 such that when in the unstressed condition, the catch 18 thereof will be disposed substantially adjacent the periphery of the can body 11 in order to facilitate the subsequent stretching of its body and engagement of the catch 18 with the handle 20 as provided on the periphery of the can body 11. It will be understood that the size and positioning of the clamp element 16 is selected to ensure that the clamp element must be tensioned or stressed in order to engage the handle 20, and thereafter remains in the stressed condition when the trash can protector of the present invention is disposed as shown in FIG. 1 of the drawing, thereby securely interlocking the can body 11, lid 10 and cover member 1 as an integral assembly which is in turn anchored to the stationary upright support 3. With this relationship the cover member opening 13 cooperates with the can lid handle 12 to provide horizontal anchoring means while the clamp element 16, having its catch 18 resiliently engaging the can handle 20, provides positive vertical anchoring means.

With the foregoing description in mind it will now be appreciated that even if a large animal or extremely strong wind were to laterally strike the can body 11 it would be highly improbable that any separation would occur between the can body and its lid.

The embodiment as illustrated in FIG. 4 of the drawing reflects an arrangement which may be provided to offer alternate horizontal anchoring means in the case of a can lid which does not have a handle provided on its top surface. In this instance, a handle 12' is shown projecting radially from the periphery of the lid 10' and, accordingly, a plurality of blocks 21 are attached to the undersurface of the cover member 1, preferably in an equi-spaced manner, each with its inner surface 22 juxtaposed the periphery 10'' of the lid 10' to preclude any lateral or horizontal displacement of the lid and its can when the cover member 1 is thus disposed. In this embodiment the same vertical anchoring means comprising the clamp element 16 as shown and described in connection with the structure of FIG. 1 may be employed.

Quite obviously, any number of cans 11 may be accommodated by a single cover member by providing a corresponding number of openings 13 and clamp elements 16 longitudinally aligned along the length of the cover member.

I claim:

1. A protector device for a can having a peripheral handle, including, a cover member pivotally secured to a relatively stationary support and movable to a substantially horizontal plane engaging said can in an overlying manner, a can lid removably attached to the top of said can, said pivotally secured cover member provided with anchor means engaging said can lid only when said cover member is pivotally lowered to a horizontal plane overlying said can lid disposed upon said can to preclude horizontal displacement of said can lid, and flexible clamping means carried by said cover member engageable with said can peripheral handle to prevent relative vertical displacement between said can, can lid and pivotally secured cover member and to retain said can and overlying can lid as an assembled unit in fixed proximity to said stationary support by means of said pivotal cover member.

2. A protector device according to claim 1 wherein, said can lid includes a handle projecting upwardly from its top surface and said cover member anchor means comprises an opening through said cover member within which said lid handle is disposed when said cover member is lowered to a horizontal plane.

3. A protector device according to claim 1 including, a cover member having a plurality of said anchor means engageable with a corresponding number of said cans and can lids.

4. A protector device according to claim 1 wherein, the lateral limits of said cover member project beyond the peripheral dimensions of said can and lid.

5. A protector device according to claim 1 wherein, said anchor means precluding horizontal displacement includes a plurality of blocks attached to the undersurface to said cover member, said blocks each having an inner surface juxtaposed the periphery of said can lid.

6. A protector device according to claim 1 wherein, said cover member comprises a corrugated sheet having alternate peaks and valleys.

7. A protector device according to claim 6 wherein, said can lid includes a handle projecting upwardly from its top surface and said anchor means precluding horizontal displacement comprises an opening through said cover member within which said lid handle is disposed, and said opening is provided through one said valley.

* * * * *